United States Patent [19]

Khoe

[11] Patent Number: 4,466,200

[45] Date of Patent: Aug. 21, 1984

[54] PROCESS AND APPARATUS FOR DRYING A GRANULAR FREE FLOWING BULK MATERIAL

[76] Inventor: Giok-Khoen Khoe, Jac. v. Heemskercklaan 35, 2253 JX Voorschoten, Netherlands

[21] Appl. No.: 328,549

[22] PCT Filed: Apr. 3, 1981

[86] PCT No.: PCT/NL81/00009

§ 371 Date: Nov. 24, 1981

§ 102(e) Date: Nov. 14, 1981

[87] PCT Pub. No.: WO81/02924

PCT Pub. Date: Oct. 15, 1981

[30] Foreign Application Priority Data

Apr. 3, 1980 [NL] Netherlands ..... 8001980

[51] Int. Cl.[3] ..... F26B 3/10; F26B 17/10

[52] U.S. Cl. ..... 34/10; 34/57 A; 34/102; 34/168

[58] Field of Search ..... 34/10, 57 A, 168, 102, 34/57 R; 432/15, 58; 406/137, 142, 143, 146

[56] References Cited

U.S. PATENT DOCUMENTS

| | | | |
|---|---|---|---|
| 2,786,280 | 3/1957 | Gishler et al. | 34/57 A |
| 3,911,594 | 10/1975 | McIntire et al. | 34/102 |
| 4,349,967 | 9/1982 | Jones et al. | 34/10 |
| 4,373,272 | 2/1983 | Jones et al. | 34/102 |

*Primary Examiner*—Larry I. Schwartz

*Attorney, Agent, or Firm*—Ladas & Parry

[57] ABSTRACT

Process and device for convectively drying granular bulk material in a silo. A hot gas jet is vertically blown upward through a jet nozzle or jet aperture (orifice), a tube having a wall closed over is entire length is inserted into the bulk material coaxially with the axis of the vertical gas jet, the tube being lowered up to a particular distance above the bottom of the silo, in such a way that continuously an amount of the descending bulk material is entrained by the recycling gas jet and is blown into the vertically introduced upwardly directed jet of hot drying gas and the tube is of such a length that it projects with its top above the bulk material.

4 Claims, 3 Drawing Figures

PROCESS AND APPARATUS FOR DRYING A GRANULAR FREE FLOWING BULK MATERIAL

A process for conveniently drying and optionally roasting and peeling/grinding a granular free-flowing bulk material and a device for carrying out the process.

The invention relates to a process for convectively drying a granular free-flowing bulk material, according to which the bulk material is passed into a silo and a vertically introduced, upwardly directed jet of hot drying gas is introduced into the silo via a jet nozzle or jet aperture (orifice), in such a way that granules are continously entrained by part of said gas jet along a straight upward path to above the bulk material and fall down as a fountain onto the surrounding bulk material which slowly descends in the silo, whereas another part of the gas jet is laterally deflected and flows downward as a recycle stream.

A similar process is known from U.S. Pat. No. 2,786,280. Therein the gas jet is freely blown into the bulk material present in the silo via a jet nozzle or jet aperture (orifice) disposed in the bottom of the silo. A portion of the gas jet flows upward along a straight path, entraining the bulk material granules being at its path and causes a cylindrical channel bounded by the surrounding slowly descending bulk material; another portion of the gas jet, as applicants' investigation taught, deflects laterally and then flows downward (recycle stream); the remainder of the introduced gas jet (in practice often half to three quarters of it) deflects laterally on its way up and flows away upward through the surrounding bulk material.

This process gives a high drying efficiency, especially thanks to the laterally deflected and upwardly flowing gas.

When this process is applied to bulk material where the resistance controlling the moisture transport is in the granules, for instance to granular agricultural products, it only gives a constant drying rate at the initial stage with as a result that with bulk material of this kind the granules can easily damage, for instance get cracked, in consequence of which the useful value of bulk material dried with this known process is strongly reduced.

Moreover, the system allows of little variation. The filling level of the silo for instance cannot be altered and alteration of the output of the air jet is hardly possible as well.

It has now been found that by controlling the amount of laterally deflected and upwardly flowing drying gas a constant drying rate can be achieved. This can be explained in that the granules which are entrained by the upward flowing portion of the gas jet along a straight path give up the moisture present in the outer layer to the driving gas, whilst—as the moisture transport controlling resistance is within the granules—the moisture distribution in the core of the granules hardly changes and that thereupon the granules when they have fallen to the surrounding bulk material and slowly descend steadily with this bulk material, get sufficient opportunity for levelling out the unequal distribution of moisture which has been obtained in the gas jet, and those granules are then reintroduced into the vertically introduced gas jet by means of the recycle stream and are entrained by the portion of the gas jet flowing upward along a straight path, whereupon the whole cycle is repeated. By controlling the amount of laterally deflected and upwardly flowing gas and the recycle stream, same can be attuned to the nature of the bulk material and the drying result aimed at.

The process according to the invention is characterized, in that during the drying of bulk material, where the moisture transport controlling resistance is within the granules, a tube having a wall closed along its entire length is inserted into the bulk material coaxially with the axis of the vertical gas jet, the tube being lowered up to a predetermined distance above the bottom of the silo, in such a way that continuously an amount of the descending bulk material is entrained by the recycling gas jet and is blown into the vertically introduced upwardly directed jet of hot drying gas, and the tube is of such a length that it projects with its upmost end above the bulk material.

With this embodiment i.a. the following advantages are obtained.

Thanks to the tube inserted into the bulk material phenomena occurring in the silo can accurately be controlled. Much greater variations in the output of the drying gas can be allowed than is the case with the process according to U.S. Pat. No. 2,786,280 and even halve the output of the gas compared to the output required in the process according to U.S. Pat. No. 2,786,280, whereas the pressure at which the gas is blown-in may be smaller and may amount to about $\frac{2}{3}$ of the pressure in the known process. Furthermore, maximum limits are no longer set to the filling level of the silo; in the process according U.S. Pat. No. 2,786,280 a maximum applies for the filling level, because when the filling level becomes too high, no continuous gas flow occurs anymore and all the gas is spread through the bulk material.

The diameter of the tube inserted into the bulk material in accordance with the invention has to be such that granules of the bulk material which are entrained by the gas jet are shot into the tube as much as possible and are then entrained at high speed to above the bulk material present in the silo. In practice this means that the inner diameter of the tube must at least be equal to the diameter of the jet nozzle or jet aperture (orifice) through which the gas flow is introduced into the silo. On the other hand the inner diameter of the tube preferably should not be larger than twice the average diameter of the straight upward path along which without application of a tube granules of bulk material are entrained by the gas jet to above the bulk material.

Preferably, the inner diameter of the tube inserted into the bulk material is nearly equal to the average diameter of the straight upward path along which without application of a tube granules of bulk material are entrained by the gas jet to above the bulk material. In practice this means that the inner diameter of the tube preferably amounts to 0.8–1.2 times the average diameter of this straight upward path. With such an inner diameter of the tube inserted into the bulk material, the least disturbances in the flow occur and the most favourable control of the drying process is attained.

The diameter of the straight upward path along which without application of a tube inserted into the bulk material granules of bulk material are entrained by the gas jet to above the bulk material depends on the nature of the bulk material which is dried in the silo, on the diameter of the silo and on the diameter of the nozzle or orifice through which the gas jet is introduced into the silo.

In practice this diameter is established experimentally, for instance by filling the silo to be used according to the invention with the bulk material to be dried in this silo up to the maximal level at which with the available drying gas output—without tube inserted into the bulk material—still an upward gas jet along a straight path is realized in which granules of the bulk material are entrained to above the level of the surrounding bulk material, by blowing the maximum available jet of drying gas into the silo via the nozzle or orifice in the bottom of the silo and measuring the kinetic pressure over a cross-section.

For an accurate determination of the diameter of the straight upward path along which, without application of a tube inserted into the bulk material, granules of bulk material are entrained by the gas jet to above the bulk material, such a test can suitably be carried out in a silo which is halved by means of a transparent sheet running through the axis of the silo, blowing half the amount of gas in at the same filling level with bulk material. The cross-section of the straight upward path is then visible through the transparent sheet and can easily be measured.

The distance between the lower end of the tube inserted into the bulk material and the bottom of the silo which is kept in the process according to the invention, determines to a high degree the flow pattern which occurs in the process according to the invention in the silo and therewith the drying result aimed at.

This is further described and illustrated hereinunder with the aid of the figures, of which:

FIG. 1 shows the flow pattern occurring in a silo when carrying out the drying process according to U.S. Pat. No. 2,786,280;

Figure 1:
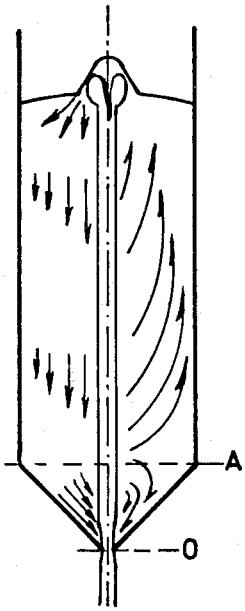

FIG. 1 shows the flow pattern occurring in practice in the silo in the process according to U.S. Pat. No. 2,786,280. The flow of the gas is indicated by half arrows; the movement of the granular bulk material is indicated by complete arrows.

This flow pattern can be explained as follows.

The gas entering the silo at O via a nozzle or orifice with a particular momentum looses part of its momentum on its way through the silo; the rate decreases as a function of the distance from O. This decrease of the rate is attended by a gradual increase of the static pressure along the axis of the silo (the gas jet) which increase of the static pressure is restricted, however, by dissipation losses and according as the dissipation losses increase even turns into a decrease of the static pressure. Consequently, at a particular point (A) along the axis of the gas jet a pressure peak occurs.

The static pressure which occurs along the axis of the gas jet causes part of the gas from the gas jet to deflect laterally. Below point (A) this laterally deflected gas flows back to O where it mixes with gas freshly introduced at O. This recycling gas entrains granules from the surrounding bulk mass and takes them into the gas jet. Above the point (A) the laterally deflected gas flows upward into the surrounding bulk material mass. Because granules are continuously entrained by the recycling gas to the gas jet at the lower end of the bulk mass, the bulk mass slowly descends. At the top it is replenished by bulk granules which have been entrained by the gas jet to above the bulk material and fall there as a fountain onto the surrounding bulk material.

By inserting a tube into the bulk material coaxially with the axis of the vertical gas stream, a part of the flow of gas through the surrounding bulk material is avoided.

For a tube having an inner diameter which is substantially equal to the average diameter of the straight upward path along which—without application of a tube—granules of bulk material are entrained by the gas jet, the following cases may occur.

When the lower end of the tube is at less than half of the distance OA from the bottom of the silo, the gas jet blown-in through the nozzle or orifice sucks additional gas through the bulk material present around the tube, said gas entraining granules; the amount of sucked gas and therewith the amount of entrained granules is determined by the distance of the lower end of the tube to the bottom of the silo and by the output of the gas jet blown-in through the nozzle or orifice.

Such a position of the tube is generally not wanted in practice.

When the lower end of the tube is between half of the distance OA and the point A part of the blown-in gas jet is deflected laterally and sucked back to the gas inlet; besides additional gas is also sucked in through the bulk material present around the tube. This is a suitable position of the tube.

When the lower end of the tube is at the level of point A only a recycle stream of laterally deflected gas occurs.

The output of the gas jet through the tube is equal to the output of the gas introduced via the nozzle. Also this position of the tube is suitable.

When the lower end of the tube is above point A, the incoming gas jet is divided into a jet going upward through the tube and a stream going upward through the bulk material present about the tube. Besides an unimpeded recycle stream occurs. The distribution between the gas jet through the tube and the gas stream upward through the surrounding bulk material and with it the concentration of the suspension of granules which goes upward with the gas jet is determined by the precise position of the tube.

In general, when the lower end of the tube is above point A, the most favourable drying effect occurs. Such a position of the tube is therefore preferred. The precise position of the tube selected for drying a particular bulk material, also depends on by-effects which may be wanted.

Because the granules move upward as a thin suspension in the gas jet, they also regularly collide, against each other and against the wall of the tube, effecting a grinding effect. The grinding effect is especially determined by the gas inlet velocity and by controlling this velocity the grinding effect can be controlled. This can be made use of for both drying the granules and removing the outer layer of the granules.

This possibility is in particular important for the drying of granular agricultural crops, where often in addition to drying also grinding or peeling has to take place.

A favourable circumstance is that in the process of the invention the ground portion is immediately separated from the remainder. This takes place by blowing away (with small particles) or segration (with large peelings), in which latter case the peelings as it were float above the surface of the surrounding bulk material.

The silo which is applied in the process according to the invention may have any dimensions. In general the diameter has to be at least 15 cms, but the upper limit for the diameter is only determined by practical considerations.

When the diameter of the silo, which in view of a particular drying capacity is desirable would become very large, a plurality of jets of drying gas can be applied in the silo, each gas jet giving the drying and grinding effect for part of the silo.

A suitable selection of the diameter of the silo, in combination with the selection of the filling level makes it possible to adjust the total duration of a drying cycle.

In the process of the invention air can be used as drying gas. In case the bulk material to be dried is sensitive to oxygen, instead of air an inert gas for instance nitrogen can be applied.

The temperature at which the gas is heated depends on the properties of the bulk material that is dried and upon the result one wishes to achieve.

The process of the invention can be applied with a wide variety of granular products which are used as bulk material.

The most important among them are the granular agricultural products, varying from grains to for instance coffee beans and oleiferous seeds. In general one wishes to dry and optionally to peel under such conditions that no granule degradation occurs as a result of the granule temperature attained.

This is reached when the temperature of the drying gas is not higher than 200° C., in particular 160° C.

Then the temperature of the granules does not become so high that degradation occurs. The most favourable temperature can simply be established experimentally.

With oleiferous seeds it often is favourable to apply a higher gas temperature for effecting both drying and roasting of the granules.

Sesame-seed for instance is roasted at temperatures of about 100°-110° C. and then a gas temperature is to be applied giving such a temperature of the granules. For this purpose the temperature of the gas should be above 160° C. and preferably above 200° C. The most suitable temperature can also here simply be established experimentally.

For coffee-beans it is favourable when they are simultaneously dried and roasted. The temperature for roasting coffee is usually at about 300° C. The most favourable gas temperature again can be established experimentally.

The process according to the invention can be performed both batch-wise and continuously. In the first case the silo is filled up to the desired level, whereupon a gas jet is introduced and this goes on until the charge is dry, whereupon the silo is emptied. In the second case the silo is filled up, a gas jet is introduced and thereupon more bulk material is continuously introduced, whilst simultaneously a corresponding amount of bulk material is withdrawn from the silo at another spot.

The invention also relates to a device for performing the process according to the invention, consisting of a silo which at its top is in communication with the open air, with in its bottom at least a supply nozzle or orifice for a gas jet, connected to a supply main for hot gas, which device is characterized in that in the silo at the level of each supply nozzle or orifice for a gas jet a tube having a wall closed over its entire length is disposed whose axis coincides with the vertical axis running through said supply nozzle or orifice, said tube ending at a certain distance above the bottom of the silo.

The silo may for instance be open at its top, but is preferably provided at its top with a cover having a gas discharge channel which may suitably be provided with a dust collector, for instance a cyclone; in this manner problems with environmental pollution are avoided.

The latter embodiment moreover offers the possibility for sucking the gas jet, which is introduced via the supply nozzle or orifice when using the device, through the silo by means of a suction pump connected to the gas discharge channel instead of blowing it into the silo by means of a compressor. In this way drying is effected at a certain sub-atmospheric pressure which in general is favourable.

A baffle is suitably disposed above each tube disposed in the silo, preferably spaced above the tube in such a way that when the device is in operation the jet of gas and entrained granules coming from the tube are deflected by it. In this way a good distribution of the falling bulk material over the surrounding bulk material mass is obtained and moreover it is avoided that granules are discharged from the device with the gas jet.

The device is preferably provided with means with which the position of the tube in the silo can be adjusted. This makes it possible to adapt the position of the tube to the bulk material which is treated, to the output of the gas jet and to the effect one wishes to achieve.

The latter possibility offers important attendant advantages especially if the device is constructed in such a way that the gas jet is sucked through the silo.

Then the silo can for instance be filled up by lowering the tube up to the bottom and sucking the bulk material from below through the tube into the silo. When the silo is filled up to the desired level in this way, thereupon the tube inserted in the silo can be slowly pulled up, whilst gas is continuously sucked through the silo, and then when the correct position of the tube in the silo is reached, the cycle patterns essential of drying occur of itself.

In the following examples some experiments are described, which illustrate the process according to the invention and the effect achieved with it.

EXAMPLE I

Some drying tests were carried out in a silo in the shape of a cylindrical vessel (inner diameter 30 cms), having a conical bottom (inclination 45°), which at its apex was provided with an inlet (jet aperture) 1 for drying air having a diameter of 27 mms, and in which a tube having a length of 1.5 m and an inner diameter of 53 mms was adjustably mounted, the axis of the tube coinciding with the axis of the silo.

The inlet for drying air was connected to a supply main for air, in which a control valve, a flow meter and an electric heater were mounted.

In all the tests 58.3 kgs of rice having a humidity based on bone-dry rice, according to NEN 3090 of 30% by weight were passed into the silo.

Via the supply nozzle air of a temperature of 160° C. was blown into the silo.

The position of the tube in the silo and the air output were varied as follows:

TABLE A

| Test | gas output (kg/s) | distance lower end of tube to bottom (cm) |
|---|---|---|
| 1 | 0.030 | 2 |

TABLE A-continued

| Test | gas output (kg/s) | distance lower end of tube to bottom (cm) |
|---|---|---|
| 2 | 0.034 | 8 |
| 3 | 0.030 | 10 |
| 4 | 0.034 | 12 |
| 5 | 0.046 | 20 |

The tests were continued until a humidity of about 16% based upon (0.16 kg $H_2O$ per kg of dry rice, corresponding to 14% based upon wet rice, which is the maximum admissible humidity for storing rice, at which the grow of mould is avoided) was reached.

The course of drying was followed by sampling rice from the silo from time to time and determining the humidity.

Figure 2:
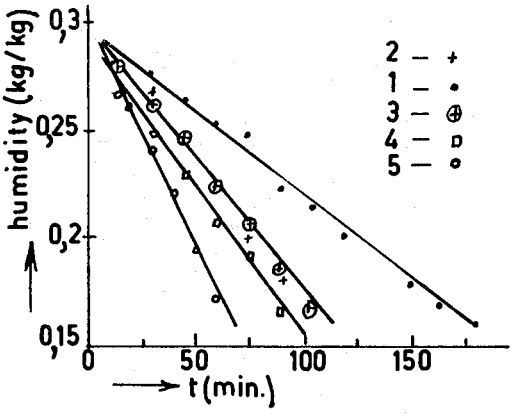
FIG. 2 shows a graph of the drying rate of rice under different experimental conditions.

The result of these tests is represented in FIG. 2.

In all cases it is achieved thanks to the tube positioned in the silo that the drying rate is constant. In consequence practically no damaging of the rice (cracking of the rice) occurs during drying.

EXAMPLE II

In the same silo as applied in the tests of example I, a further drying test was carried out. 58.5 kgs of rice having a humidity of 30%, based upon the dry rice were passed into the silo. The tube inserted in the silo was adjusted in such a way that the distance of the lower end of the tube to the bottom amounted to 8 cms and in this test 0.046 kgs/s of air having a temperature of 160° C. was blown into the silo via the supply nozzle.

The test was continued until a rest humidity was reached of about 16% (dry basis).

During the test rice was sampled from to time, both the humidity and the temperature being determined.

Figure 3:
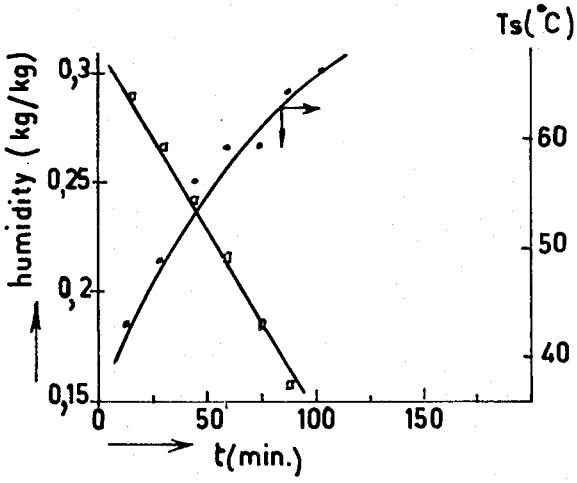
FIG. 3 shows a graph of on one side the drying rate of rice under a certain combination of conditions and on the other hand the temperature which the rice granules obtain under those conditions.

The results of these measurements are represented in FIG. 3.

Also now a constant drying rate was reached. The temperature of the rice grains increased, in spite of the gas temperature of 160° C., only to 65° C. at a humidity of 16%, a temperature at which not yet degradation of the grains occurs; a yield of unbroken dried grains was obtained of 59–63%.

I claim:

1. In a process for convectively drying a granular free-flowing bulk material, wherein the bulk material passes downwardly through a silo and a vertically introduced, upwardly directed jet of hot drying gas is introduced into a lower part of the silo via a jet nozzle or jet aperture (orifice) in such a way that granules are entrained and recycled by said jet of hot drying gas and fall onto the surrounding bulk material, a tube having a wall closed along its entire length is inserted into the bulk material coaxially with the axis of the vertical gas jet and said tube is of such a length that it projects with its upmost end above the bulk material, the improvement which comprises the tube being adjustable to predetermined distances above the bottom of the silo, such that continuously an amount of the descending bulk material is drawn into the vertically introduced upwardly directed jet of hot drying gas is blown through the tube and is recycled on to the surrounding material.

2. A process according to claim 1, wherein the tube is inserted into the bulk material to at most half of the distance between the point where on the axis of the vertical gas jet a pressure peak occurs and the bottom of the silo.

3. A process according to claim 2, wherein the tube is inserted so far into the bulk material that the lower end of the tube is above the level where on the axis of the vertical gas jet a pressure peak occurs.

4. A device for convectively drying a granular free-flowing bulk material, comprising: a silo, means for passing the bulk material downwardly through said silo and means for introducing a vertically, upwardly directed jet of hot drying gas into a lower part of the silo via a jet nozzle or jet aperture (orifice) in such a way that granules are entrained and recycled by said jet of hot drying gas and fall onto the surrounding bulk material, a tube having a wall closed along its entire length being inserted into the bulk material coaxially with the axis of the vertical gas jet and said tube being of such a length that it projects with its upmost end above the bulk material, the improvement which comprises means for adjusting the tube to predetermined distances above the bottom of the silo, such that continuously an amount of the descending bulk material is drawn into the vertically introduced upwardly directed jet of hot drying gases and is blown through the tube and is recycled onto the surrounding material.

* * * * *